US008256585B2

(12) United States Patent
Halford et al.

(10) Patent No.: US 8,256,585 B2
(45) Date of Patent: Sep. 4, 2012

(54) TAPERED BRAKE BEAM WEAR LINER

(75) Inventors: Joseph Halford, St. Louis, MO (US); Doug Compton, Glen Carbon, IL (US); Nathan Reese, Troy, IL (US); Jay Monaco, Glen Carbon, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 153 days.

(21) Appl. No.: 12/806,446

(22) Filed: Aug. 13, 2010

(65) Prior Publication Data

US 2012/0037033 A1 Feb. 16, 2012

(51) Int. Cl.
*B61H 13/36* (2006.01)

(52) U.S. Cl. ..... 188/233.3; 188/52; 105/182.1

(58) Field of Classification Search ..... 188/52, 188/54, 205 R, 207, 209, 212, 214, 219.1, 188/219.6, 233.3; 105/182.1
See application file for complete search history.

(56) References Cited

U.S. PATENT DOCUMENTS 2,808,906 A * 10/1957 Busch ..... 188/190
447,185 A 9/1984 Murphy
542,143 A 6/1995 Malachowski
5,682,964 A * 11/1997 Murphy ..... 188/52
D497,838 S 11/2004 Anderson
752,713 A1 5/2009 Wike
2011/0259685 A1* 10/2011 De-La-Fuente-Farias et al. ..... 188/233.3

OTHER PUBLICATIONS

Wear Plate For Unit Type Brake Beam Guide in Side Frame; Standard S-367-83; Adopted: 1964, Revised: 1982, 1997, 1 pg.

Design Dimensions For Unit Guide Bracket EC-2055I, Standard, S-366, Adopted: 1964, Revised: 1990, 1997, 2006, 1 pg.

* cited by examiner

*Primary Examiner* — S. Joseph Morano
*Assistant Examiner* — Zachary Kuhfuss
(74) *Attorney, Agent, or Firm* — Edward J. Brosius

(57) ABSTRACT

A brake beam wear liner for receiving a brake beam assembly includes a base wall extending between a rear end and front end. The base wall has opposite side edges. The base wall has a tapered thickness between the rear end and the front end with the base wall being thicker proximate to the rear end and being narrower proximate to the front end. The brake beam wear liner also includes side walls extending from the opposite side edges and flanges extending outward from the side walls generally opposite the base wall. The side walls and the base wall define an open ended trough configured to receive an end of the brake beam assembly.

8 Claims, 7 Drawing Sheets

TAPERED BRAKE BEAM WEAR LINER

BACKGROUND OF THE INVENTION

The subject matter herein relates to a railway car truck and, more particularly, to a railway car truck having an improved brake beam wear liner.

In a railway car truck, two axles are held in a pair of laterally spaced side frames, with a bolster extending laterally between and supported on each side frame. The wheels are press fit on the axles, with the ends of the axles also fitted with a roller bearing assembly. The roller bearing assembly is fit into a bearing adapter that is fit into a pedestal jaw opening at the longitudinal end of each side frame.

Each railway car truck also includes a braking system having two brake beams that act to transmit braking force through brake shoes to the outer tread of the railway wheels. The brake beams are attached to the side frames in corresponding guide brackets (AAR standard S-366, 2006 revision). For example, ends of the brake beams are received in the guide brackets. The brake beams are movable within the guide brackets during application of the braking system. Typically, wear plates (AAR standard S-367, 1997 revision) are positioned within the guide brackets. The wear plates have a base wall, opposed sidewalls and flanges extending from the ends of the sidewalls opposite the base wall.

During operation, the side frames tend to shift with respect to one another, such as when the railway car truck is going around a bend, or when the load supported by the railway car truck shifts or changes. The side frames may tend to shift inboard, which could squeeze in on the brake beam. As such, the brake beam is typically sized to create a gap or tolerance between the wear plates to avoid binding of the brake beams. However, such gap may be too wide in some situations, such as when the side frames are shifted outboard, when the brake beam is off-center or kinked out of alignment, or when the brake beam used is undersized for the particular rail gauge. When the gap is too wide, the brake beam is allowed to migrate within the pockets of the guide brackets, which could lead to damage of the railway wheels. For example, when the brake beam shifts over to one side or the other, the brake shoe and/or the brake head holding the brake shoe may begin to rub on the flange of the railway wheel, causing damage and/or failure of the railway wheel. Furthermore, the problem with brake beam shift may be exaggerated on particular types of railway cars, such as hopper cars, where the lever actuating the brake beam is angled to one side. As the brake beam is pulled to the side, the brake shoe and/or the brake head are similarly pulled toward the flange of the railway wheel.

A need exists for an improved railway car truck having a brake beam wear liner that can compensate for conditions where the brake beam is off-center during a braking condition.

BRIEF DESCRIPTION OF THE INVENTION

In one embodiment, a brake beam wear liner is provided for receiving a brake beam assembly. The brake beam wear liner includes a base wall extending between a rear end and front end. The base wall has opposite side edges. The base wall has a tapered thickness between the rear end and the front end with the base wall being thicker proximate to the rear end and being narrower proximate to the front end. The brake beam wear liner also includes side walls extending from the opposite side edges and flanges extending outward from the side walls generally opposite the base wall. The side walls and the base wall define an open ended trough configured to receive an end of the brake beam assembly.

In another embodiment, a brake system for a railway car truck is provided that includes a brake beam assembly configured to be mounted between opposed side frames of the railway car truck. The brake beam assembly having a brake beam with opposite ends and paddles at the ends and having brake heads proximate to the ends of the brake beam where each brake head holds a brake shoe configured to engage a wheel. The brake system also includes brake beam wear liners configured to be received in corresponding guide brackets on the side frames. The brake beam wear liners each include a base wall extending between a rear end and front end. The base wall has opposite side edges. The base wall has a tapered thickness between the rear end and the front end with the base wall being thicker proximate to the rear end and being narrower proximate to the front end. The brake beam wear liner also includes side walls extending from the opposite side edges and flanges extending outward from the side walls generally opposite the base wall. The side walls and the base wall define an open ended trough configured to receive an end of the brake beam assembly.

In a further embodiment, a railway car truck is provided that includes two side frames each having a pedestal formed on longitudinally opposite ends thereof. Each side frame has a pair of guide brackets on an inner side of the side frame. A bolster extends transverse relative to the side frames and has laterally opposite ends supported by the side frames. Brake beam assemblies are supported on the bolster and side frames. Each brake beam assembly includes elongated brake beam having opposite ends and paddles at the ends, with brake heads proximate to the ends of the brake beam, each holding a brake shoe configured to engage a wheel. The railway car truck also includes brake beam wear liners received in corresponding guide brackets on the side frames. The brake beam wear liners each include a base wall extending between a rear end and front end. The base wall has opposite side edges. The base wall has a tapered thickness between the rear end and the front end with the base wall being thicker proximate to the rear end and being narrower proximate to the front end. The brake beam wear liner also includes side walls extending from the opposite side edges and flanges extending outward from the side walls generally opposite the base wall. The side walls and the base wall define an open ended trough configured to receive an end of the brake beam assembly.

DETAILED DESCRIPTION OF THE INVENTION

Figure 1:
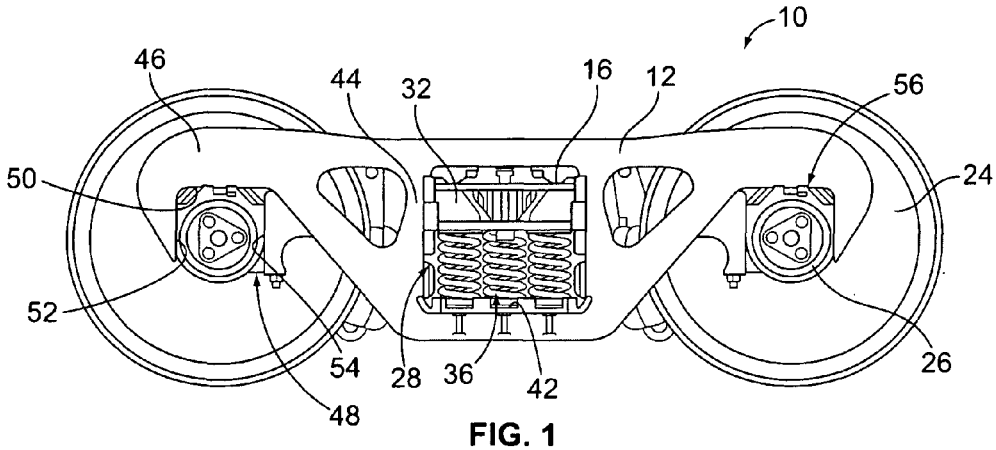
FIG. 1 is a side view of a railway car truck formed in accordance with an exemplary embodiment.
Figure 2:
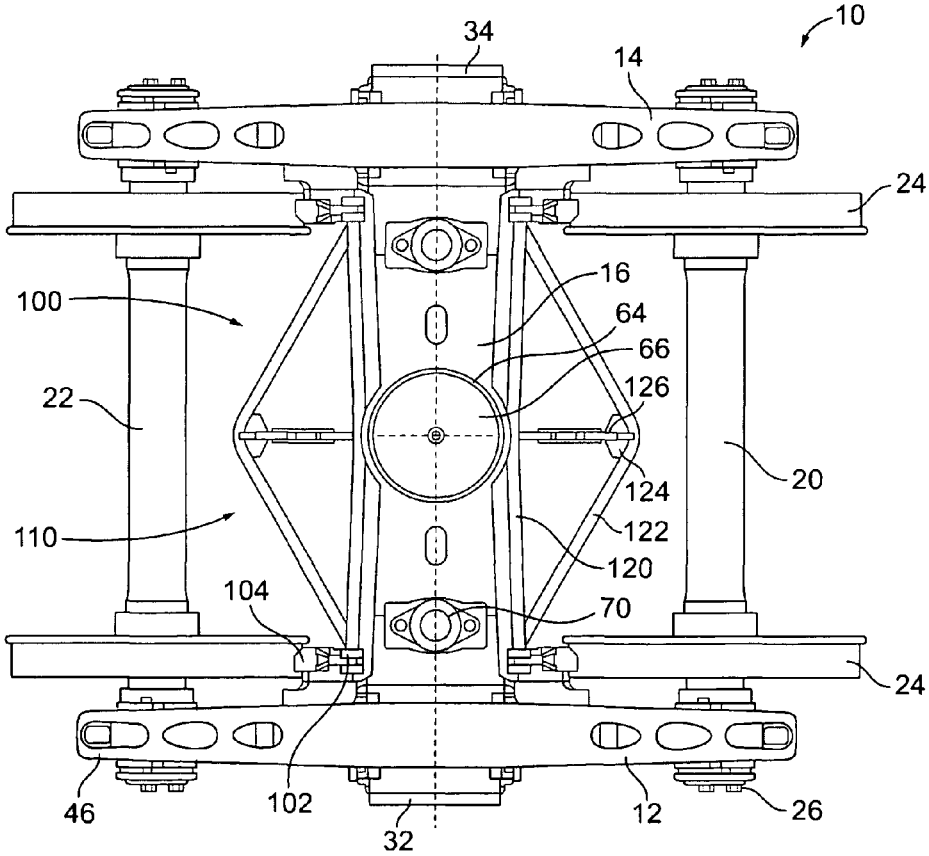
FIG. 2 is a top view of the railway car truck shown in FIG. 1.
Figure 3:
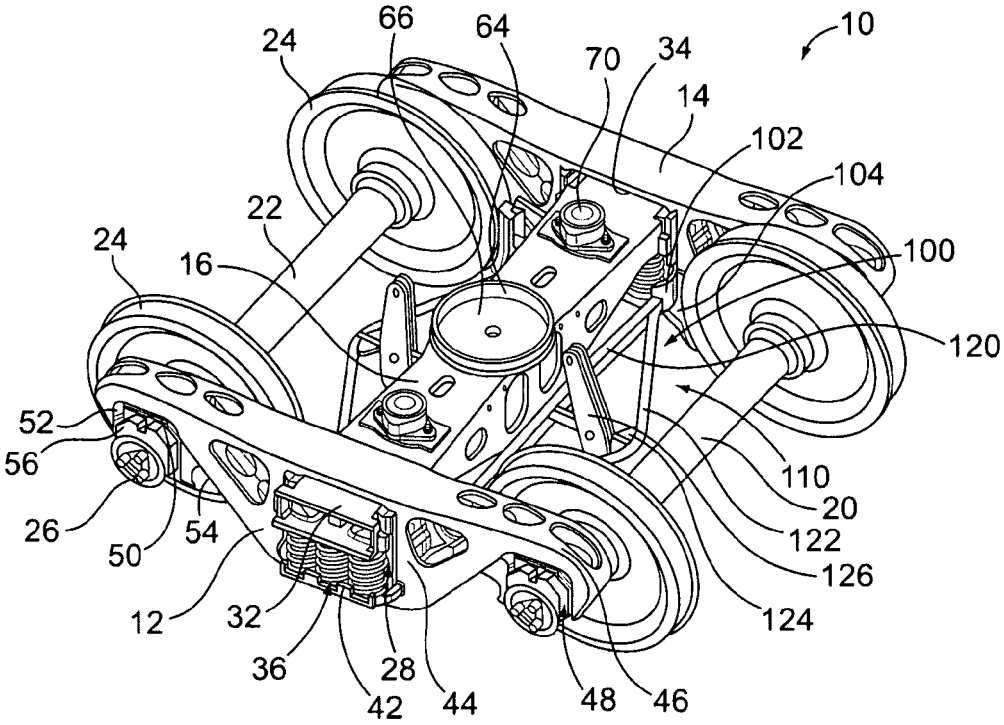
FIG. 3 is a perspective view of the railway car truck shown in FIG. 1.

Referring now to FIGS. 1-3, a railway car truck 10 is shown. The railway car truck 10 includes two laterally spaced side frames 12 and 14, between which a bolster 16 extends. Each of the side frames 12, 14 and bolster 16 are usually a cast steel unitary structure. Various internal ribs and supports lend strength, along with a savings in overall weight for each of such cast steel truck components.

Axles 20 and 22 extend laterally between the side frames 12, 14. Railway wheels 24 are press fit on the ends of the axles 20, 22. Roller bearing assemblies 26 are also provided on the ends of the axles 20, 22. The side frames 12, 14 include side frame openings 28 aligned with the bolster 16.

The bolster 16 is seen to include bolster ends 32 and 34, which extend through the side frame openings 28. Spring groups 36 support the bolster ends 32 on a side frame lower support 42. The side frames 12, 14 include vertical columns 44 that are longitudinally spaced and form the side frame openings 28 therebetween. The lower support section 42 has various raised structures adapted to position the spring group 36 thereupon.

The side frames 12, 14 are also seen to have laterally spaced pedestal jaws 46 which are the further most lateral extent of the side frames 12, 14. Each pedestal jaw 46 forms a pedestal jaw opening 48, which is comprised of a roof section 50, an outer wall 52, and an inner wall 54. The pedestal jaw opening 48 is adapted to receive a bearing adapter 56 therein. The bearing adaptors 56 rest on the roller bearing assemblies 26.

The bolster 16 includes on its upper surface a bolster center plate 64, which includes a bolster center plate wear liner 66. Also included on the upper surface of the bolster 16 is a pair of laterally spaced side bearings 70.

The railway car truck 10 includes a brake system 100 having brake heads 102 that support brake shoes 104. The brake system 100 is operated to press the brake shoes 104 against the railway wheels 24. The brake heads 102 may be fabricated or cast steel devices. The brake system 100 includes a brake beam assembly 110 supported from the side frames 12, 14 and the bolster 16.

The brake beam assembly 110 includes a brake beam 120, which is generally elongated and extends laterally between the side frames 12, 14. The brake shoes 104 are provided proximate to the ends of the brake beam 120, generally aligned with the railway wheels 24. Support sections 122 extend at acute angles from ends of the brake beam 120. A standoff section 124 extends from a center portion of the brake beam 120 to the apex of the curved or bent support sections 122. The brake beams 120, support sections 122 and standoff sections 124 are typically comprised of structural steel, and may be in the form of a hollow structural steel sections. One or more levers 126 are connected to the brake beam assembly 110, such as to the standoff sections 124, to actuate the brake beam assembly 110 during braking. The levers 126 may be oriented substantially vertically. Alternatively, the levers 126 may be angled, such as at approximately a 45° angle, such as on a hopper freight car, where clearance above the levers 126 is limited. When angled, the levers 126 tend to pull the brake beam assembly 110 toward one side of the railway car truck 10, which may cause the brake shoes 104 to rub against the railway wheels 24 causing damage to the railway wheels 24.

Figure 4:
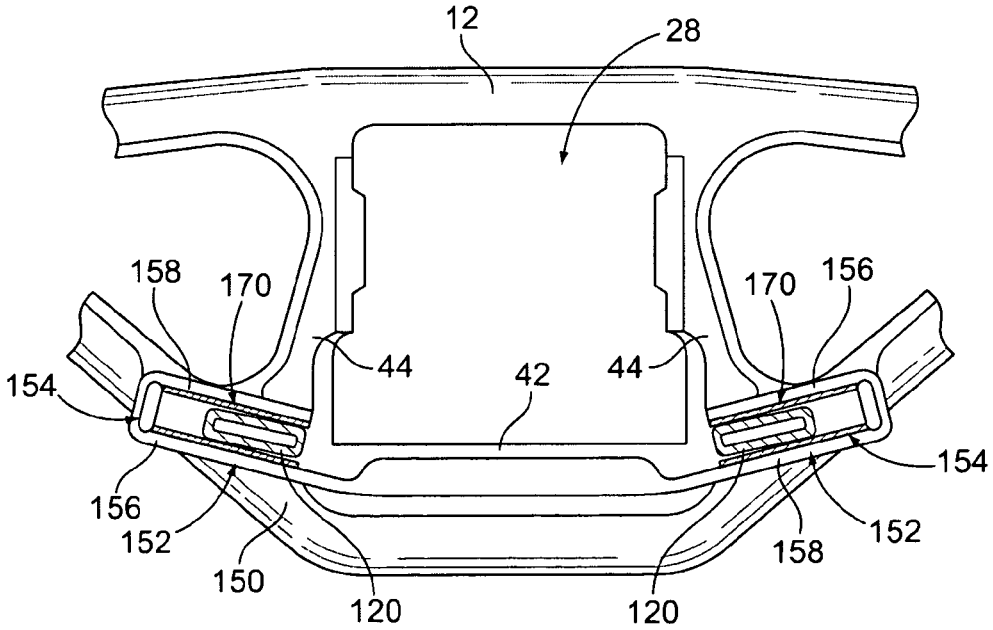
FIG. 4 is a side view of a portion of the railway car truck shown in FIG. 1.

FIG. 4 is a side view of a portion of the railway car truck 10 illustrating a portion of an inner side 150 of the side frame 14. The side frame 14 includes guide brackets 152 extending inward from the side frame 14. Optionally, the guide brackets 152 integrally formed with the side frame 14. The guide brackets 152 are positioned along the vertical column 44 proximate to the side frame opening 28. The guide brackets 152 are positioned proximate to the lower support section 42 on each side of the side frame opening 28. Similarly, the side frame 12 (shown in FIGS. 2 and 3) includes a pair of guide brackets that are substantially similar to the guide brackets 152.

The guide bracket 152 includes a pocket 154 that is surrounded by an upper wall 156 and a lower wall 158. The upper and lower walls 156, 158 are substantially parallel to one another and project from the side frame 14 to define the pocket 154. In an exemplary embodiment, the guide bracket 152 has an open side furthest from the side frame 14 that provides access to the pocket 154. The open side extends between the upper and lower walls 156, 158. The pocket 154 receives a brake beam wear liner 170 which receives an end of the brake beam 120. In an exemplary embodiment, the guide brackets 152 may conform to AAR standards S-366. The AAR standards call for the guide bracket 152 to be inclined to the horizontal at an angle of 14° for 40, 50, 70, and 90-100 ton cars, and at an angle of 16° for 125 ton cars.

Figure 6:
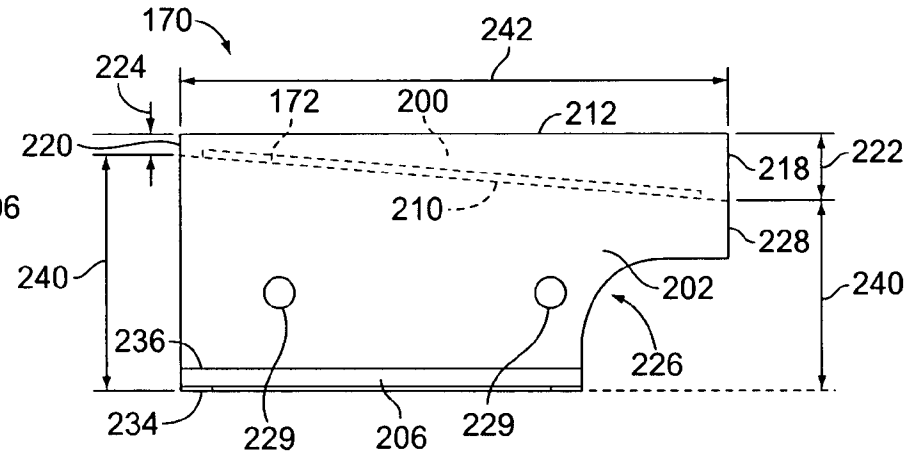
FIG. 6 is a top view of the brake beam wear liner shown in FIG. 5.
Figure 7:
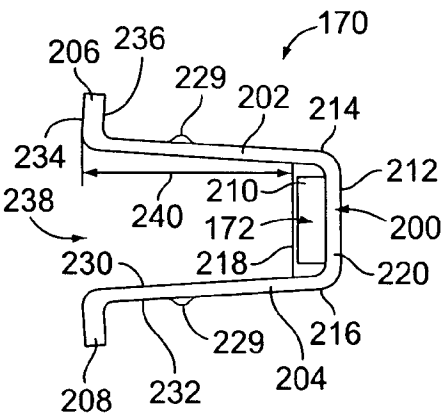
FIG. 7 is an end view of the brake beam wear liner shown in FIG. 5.
Figure 5:
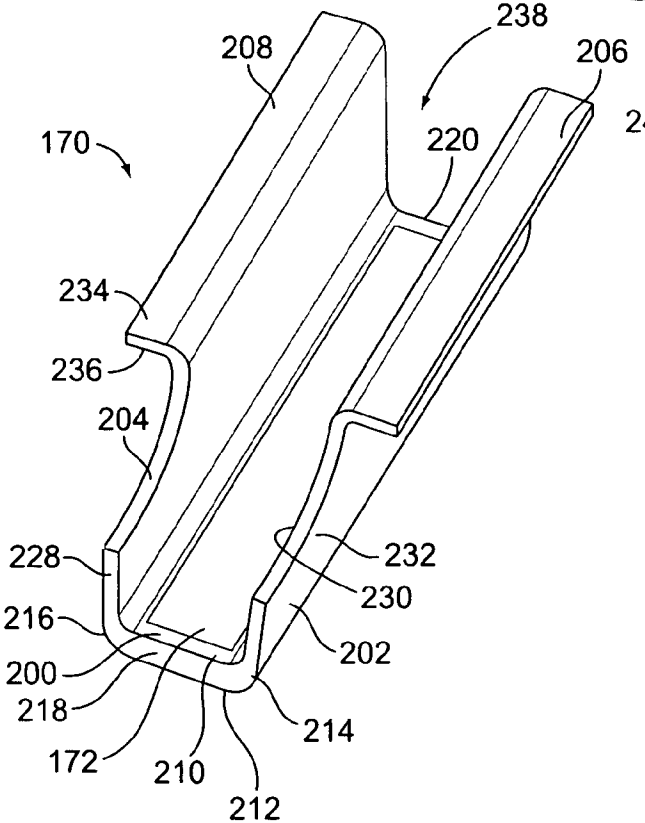
FIG. 5 is a perspective view of a brake beam wear liner for the railway car truck shown in FIG. 1.

With reference to FIGS. 5-7, a brake beam wear liner 170 is shown. The brake beam wear liner 170 includes a base wall 200, side walls 202, 204 extending from the base wall 200 and flanges 206, 208 extending from the side walls 202, 204, respectively. The brake beam wear liner 170 is configured to be received in corresponding pockets 154 (shown in FIG. 4) of the guide brackets 152 (shown in FIG. 4). The brake beam wear liner 170 defines an open ended trough 238 between the side walls 202, 204. The base wall 200 is provided at a bottom of the trough 238 opposite the open end of the trough 238.

In an exemplary embodiment, the brake beam wear liner 170 is manufactured from a metal material, such as a cast steel material. Other types of metal materials may be used in alternative embodiments. A metal material used for the brake beam wear liner 170 may be manufactured by a process other than casting, such as stamping and forming the brake beam wear liner 170. Alternatively, the brake beam wear liner 170 may be fabricated from a synthetic material, such as a nylon material. Optionally, an impact resistant nylon material may be used. Other types of synthetic materials may be used in alternative embodiments. Optionally, the brake beam wear liner may include an insert 172 embedded in the base wall 200, where the insert 172 is manufactured from a different material than the base wall 200. The insert 172 may be manufactured from a material selected to provide certain characteristics, such as improved friction or wear characteristics as compared to the material of the base wall 200.

The base wall 200 has an inner surface 210 and an outer surface 212 extending between opposite side edges 214, 216. The base wall 200 extends between a rear end 218 and a front end 220. The base wall 200 is tapered between the rear end 218 and the front end 220 having a tapered thickness therebetween. The rear end 218 has a first thickness 222 (shown in FIG. 6) and the front end 220 has a second thickness 224

(shown in FIG. 6). The first thickness 222 is thicker and the second thickness 224 is narrower. Optionally, the first thickness 222 may be at least twice the second thickness 224. For example, the second thickness 224 may be $3/16^{th}$" (0.1875") thick, whereas the first thickness 222 may be approximately $11/16^{th}$" (0.6875") thick. Other thicknesses are possible in alternative embodiments.

Optionally, the base wall 200 may have a constant taper between the rear and front ends 218, 220, which is continuously getting thinner from the rear end 218 to the front end 220. The outer surface 212 is generally planar and the inner surface 210 is generally planar, but angled with respect to the outer surface 212 to define a ramp surface that is non-parallel with respect to the outer surface 212.

The side walls 202, 204 have cutouts 226 at a front 228 of the brake beam wear liner 170. Optionally, each cutout 226 may have a radiused surface. The side walls 202, 204 include a pair of outwardly extending rounded protuberances 229 that are configured to engage the guide bracket 152 to hold the brake beam wear liner 170 within the pocket 154. Each side wall 202, 204 has an inner surface 230 and an outer surface 234 that transition into the inner and outer surfaces 210, 212, respectively, of the base wall 200. The side walls 202, 204 extend from the opposite side edges 214, 216, respectively, of the base wall 200.

The flanges 206, 208 extend outward from the side walls 202, 204, respectively, generally opposite the base wall 200. The flanges 206, 208 have inner surfaces 234 and outer surfaces 236 that transition into the inner and outer surfaces 230, 232, respectively, of the corresponding side wall 202, 204.

The open ended trough 238 of the brake beam wear liner 170 has a variable depth 240 measured along a longitudinal length 242 thereof. The depth 240 is measured between the outer surfaces 236 of the flanges 206, 208 and the base wall 200. With the base wall 200 being tapered along the length thereof, the depth 240 changes along the length of the brake beam wear liner 170. For example, the depth 240 at the front end 220 is greater than the depth 240 at the rear end 218 (measured to the plane defined by the flanges 206, 208 opposite the base wall 200 as if the flanges 206, 208 extended the entire length of the brake beam wear liner 170). In other words, the depth 240 decreases (e.g. gets shallower) from the front end 220 to the rear end 218.

In an exemplary embodiment, portions of the brake beam wear liner 170 conform to AAR standard S-367, while other portions of the brake beam wear liner 170 do not conform to the AAR standard S-367. For example, the base wall 200 may not conform to the standard because the base wall 200 has a tapered thickness, however the remaining portions of the brake beam wear liner 170 may conform to the standard. The brake beam wear liner 170 can thus compensate for conditions where the brake beam 120 is off-center, is too short or is subject to being off-set.

Figure 8:
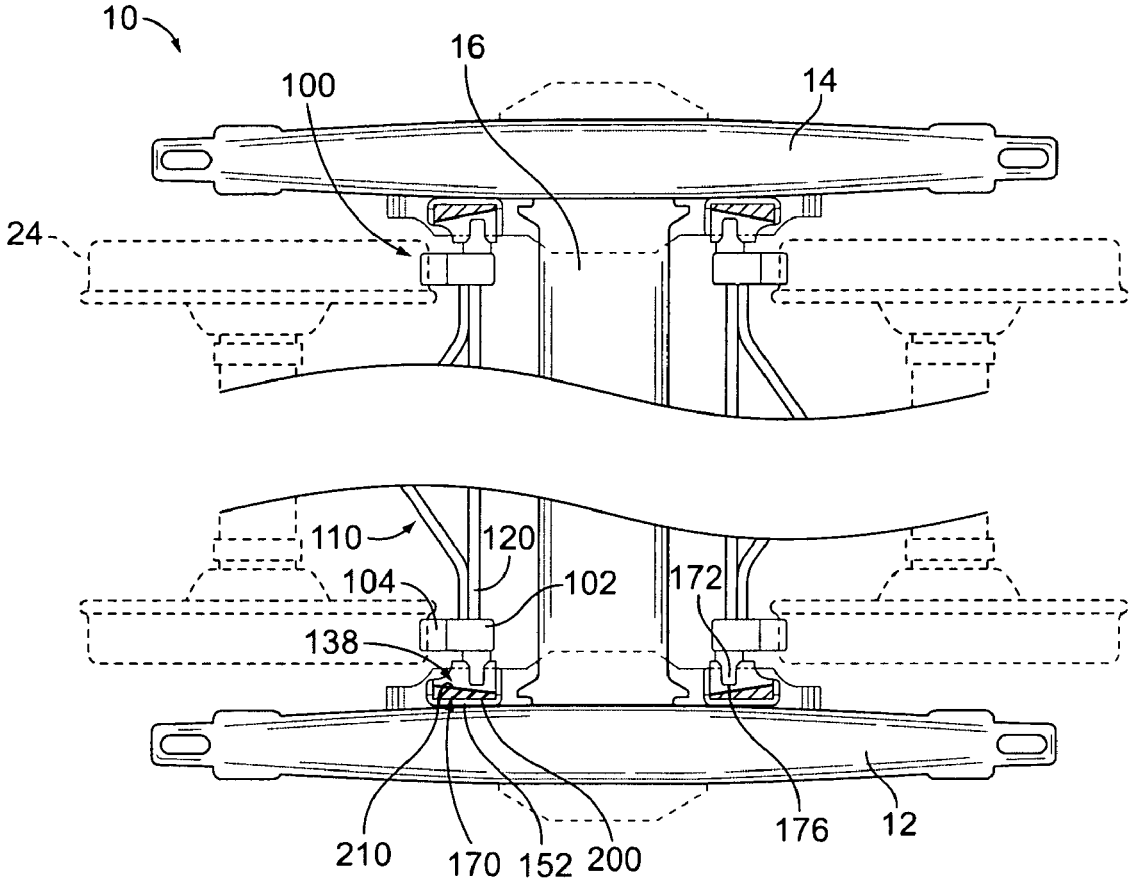
FIG. 8 is a top, partial section view of a portion of the railway truck shown in FIG. 1.

FIG. 8 is a top, partial sectional view of a portion of the railway car truck 10 illustrating brake beam wear liners 170 received in corresponding guide brackets 152 of the side frame 14. FIG. 8 also illustrates a portion of the bolster 16, the railway wheels 24 and a portion of the brake system 100. The brake heads 102 are shown coupled to the brake beam assembly 110 at ends of the brake beams 120 aligned with the railway wheels 24.

The brake beam wear liners 170 are shown loaded into the guide brackets 152. The brake beam wear liners 170 are loaded into the guide brackets 152 such that the rear ends 218 are positioned proximate to the railcar wheels 24 and the front ends 220 are inward of the rear ends 218 positioned proximate to the bolster 16. Ends of the brake beams 120 are configured to extend into the brake beam wear liner 170. For example, ends of the brake beams 120 include paddles 172 that are configured to extend into the brake beam wear liners 170. The brake beam assemblies 110 are not physically connected to the side frames 14. Rather, the brake beam assemblies 110 are free-floating between the side frames 12, 14. The brake beams 120 have an axial length measured between distal ends 176 of the paddles 172. The axial length of each brake beam 120 is selected to fit between the brake beam wear liners 170. The brake beam wear liners 170 associated with a particular brake beam 120 are spaced apart from one another by a lateral distance that is longer than the axial length of the brake beams 120. As such, binding of the brake beam 120 is reduced or eliminated.

During operation of the brake system 100, the brake beam assemblies 110 are actuated between retracted positions and advanced positions. In the retracted position, the brake beams 120 are positioned closer to the bolster 16. The paddles 172 are positioned proximate to the front ends 220 of the brake beam wear liners 170. In the advanced position, the brake beams 120 are actuated away from the bolster 16. The paddles 172 are advanced forward in the troughs 138 such that the paddles 172 are positioned proximate to the rear ends 218 of the brake beam wear liners 170. When actuated, the brake beams 120 and corresponding brake shoes 104 are pressed toward the corresponding railway wheels 24 to apply braking pressure to the railway wheels 24. The levers 126 (shown in FIG. 4) actuate the brake assemblies 110 during braking. Movement of the brake beam assemblies 110 is guided by the brake beam wear liners 170. For example, the brake beam wear liners 170 limit movement of the brake beams 120 along a generally linear path toward, and away from, the railway wheels 24 between the advanced and retracted positions. The brake beams 120 have a linear range of motion defined by the brake beam wear liners 170.

When the brake beams 120 are off-center, one of the paddles 172 may be closer to the corresponding brake beam wear liner 170. For example, such paddle 172 has a gap between the end of the paddle 172 and the base wall 200 that is smaller than a gap between the end of the opposite paddle 172 and its corresponding base wall 200. When actuated, as the paddle 172 is moved forward, the end of the paddle 172 may engage the ramped inner surface 210, which may force the brake beam 120 to shift laterally toward a centered position. Having the base walls 200 angled inward at both sides of the brake beam 120 ensures that the brake beam 120 is centered when actuated.

The added thickness of the brake beam wear liners 170 at the rear ends 218 of the base walls 200 compensate for conditions where the brake beam 120 is too short or subject to being off-set. Additionally, the axial distance between the side frames 12, 14 may change as the railway car truck 10 passes down the railway track. For example, the axial distance may increase such as when the railway car truck 10 curves around a bend or as the load supported by the railway car truck 10 shifts. Having thicker rear ends 218 may help center the brake beam 120 in such situations.

The added thickness in the brake beam wear liner 170 compensates for situations where the brake beam assembly 110 is off-center or tends to shift off-center between the side frames 12, 14, which may be caused by the levers 126 pulling the brake beams 120 toward one of the side frames 12 or 14, such as may be the case in hopper cars. When the brake beam assembly 110 is pulled to one side, the brake beam 120 may engage the brake beam wear liner 170 at that side, which operates as a lateral movement limit. Further pulling of the lever causes the brake beam 120 to move longitudinally toward the wheel 24.

The brake beam wear liners 170 are aligned with one another at the opposite ends of the brake beam 120. A rear lateral distance is defined between the front ends 220 of the brake beam wear liners 170. A front lateral distance is defined between the rear ends 218 of the brake beam wear liners 170. Because the base walls 200 are inclined at the rear ends 218, the front lateral distance is less than the rear lateral distance. In other words, there is more space between the brake beam 120 and the brake beam wear liners 170 in the retracted position at the front ends 220 than in the advanced position at the rear ends 218. Optionally, the front lateral distance may be approximately equal to the axial length of the brake beam 120 such that the distal ends of the paddles 172 touch, or approximately touch, the base walls 200 at the rear ends 218.

Gaps between the ends of the paddles 172 and the rear ends 218 may be minimal. For example, a gap between the end of one paddle 172 and the corresponding base wall 200 and a gap between the end of the other paddle 172 and the corresponding base wall 200, together define a combined rear gap. The combined rear gap may be approximately zero inches in some embodiments such that the distal ends of the paddles 172 touch, or almost touch, the base walls 200 when the brake beam 120 is in the advanced position. Alternatively, the combined rear gap may be greater than zero inches such that a gap exists between the end of at least one of the paddles 170 and the base walls 200, allowing some room for the brake beam 120 to move, which will reduce the possibility of binding of the brake beam 120 between the brake beam wear plates 170. The combined rear gap is larger than the combined front gap, which is the combined distances between the ends of the paddles 172 and the base walls 200 at the front ends 220 when the brake beam 120 is in the retracted position.

Figure 9:
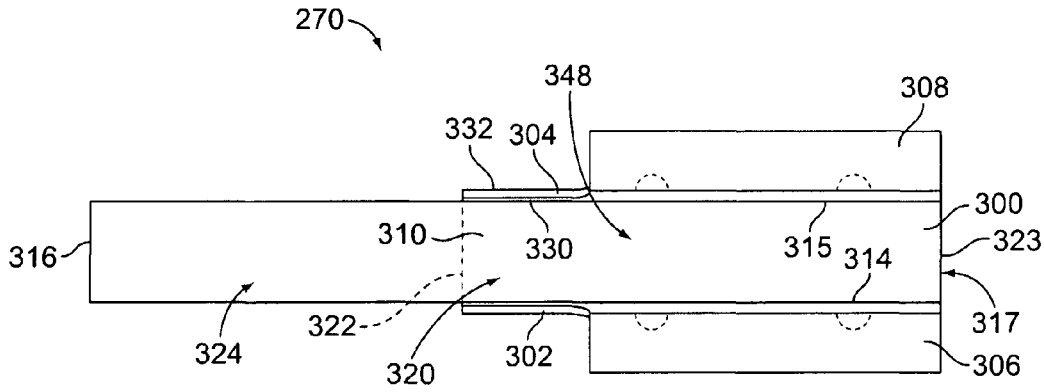
FIG. 9 is a side view of an alternative brake beam wear liner in a first stage of manufacture.
Figure 10:
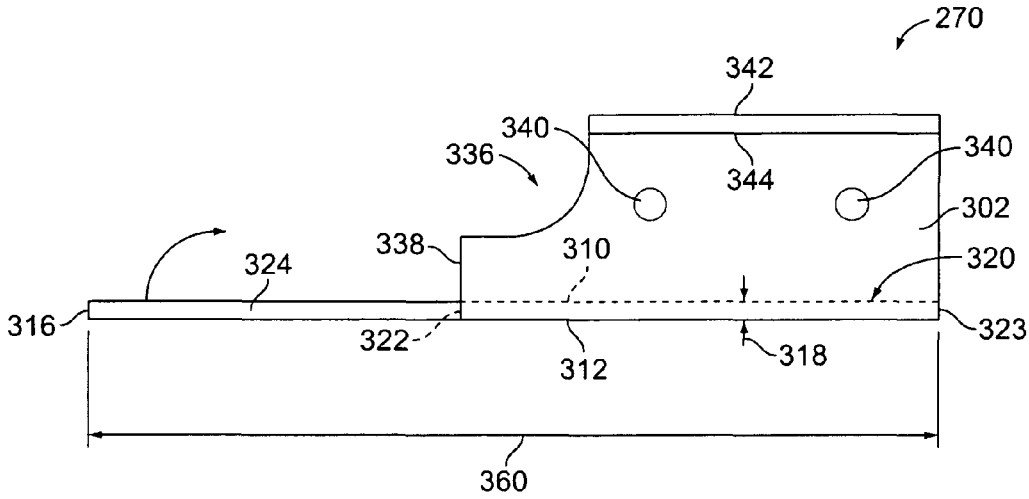
FIG. 10 is a top view of the brake beam wear liner shown in FIG. 9.
Figure 11:
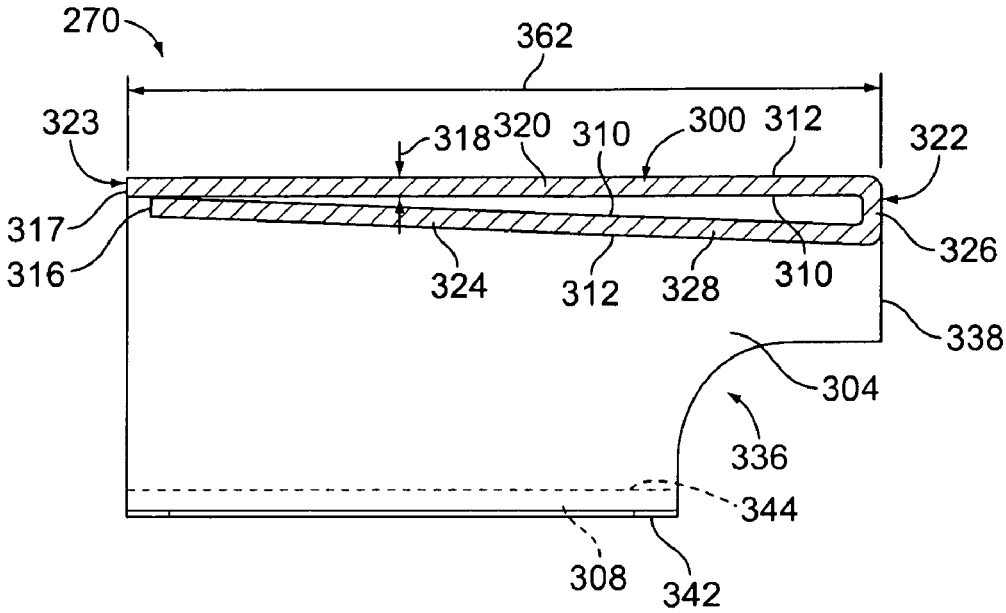
FIG. 11 is a cross sectional view of the brake beam wear liner shown in FIG. 9 in a second stage of manufacture.

With reference to FIGS. 9-11, a brake beam wear liner 270 is shown. The brake beam wear liner 270 is similar to the brake beam wear liner 170 in some respects, and may be used in place of the brake beam wear liner 170. When manufactured, the brake beam wear liner 270 may have substantially similar size, shape and dimensions as the brake beam wear liner 170, such that the brake beam wear liners 170, 270 may be interchangeable. The brake beam wear liner 270 is configured to be received in corresponding pockets 154 (shown in FIG. 5) of the guide brackets 152 (shown in FIG. 5).

The brake beam wear liner 270 includes a base wall 300, side walls 302, 304 extending from the base wall 300 and flanges 306, 308 extending from the side walls 302, 304, respectively. The brake beam wear liner 270 defines an open ended trough 348 between the side walls 302, 304. The base wall 300 is provided at a bottom of the trough 348 opposite the open end of the trough 348.

In an exemplary embodiment, the brake beam wear liner 270 is manufactured from a metal material, and is configured to be stamped and formed. For example, the brake beam wear liner 270 may be stamped from a metal piece of material and formed into the shape shown in FIGS. 9 and 10. The brake beam wear liner 270 is then further formed into the final shape shown in FIG. 11. As described in further detail below, the final forming step is performed to form an angled base wall and to add thickness to a front of the base wall 300.

The base wall 300 has an inner surface 310 and an outer surface 312 extending between opposite side edges 314, 315. The base wall 300 extends between a first end 316 and a second end 317. The base wall 300 has a constant base wall thickness 318 measured between the inner and outer surfaces 310, 312.

The base wall 300 includes a central portion 320 extending between a rear end 322 and a front end 323 (both shown in FIG. 11). The front end 323 may be the same as the second end 317. The base wall 300 also includes a first longitudinal extension 324 extending from the rear end 322 to the first end 316. The first longitudinal extension includes a wall portion 326 and a ramp portion 328. The wall portion 326 may be generally perpendicular to the central portion 320 of the base wall 300 and the ramp portion 328 may be generally angled with respect to, and extending between, the wall portion 326 and the central portion 320. Optionally, a second longitudinal extension (not shown) may extend from the front end 323, in which case, the second end 317 may be remote from the front end 323 of the central portion 320.

During manufacture, the first extension 324 is folded over or under the central portion 320, which increases a thickness of the base wall 300 at the rear end 322 and/or at the front end 323. When folded over, the first extension 324 is angled with respect to the central portion 320 such that the first extension 324 is non-parallel to the central portion 320.

In an exemplary embodiment, the first extension 324 may be cantilevered such that the distal end of the first extension 324 does not normally engage the central portion 320. The first extension 324 is deflectable such that the first extension 324 operates as a spring member configured to engage, and be spring biased against, the brake beam 120. When the brake beam 120 engages the first extension 324, the first extension 324 may be deflected inward toward the central portion 320. Such deflection may cause the first extension 324 to impart a spring force on the brake beam 120, thus forcing the brake beam 120 away from the central portion 320, which tends to center the brake beam 120.

Each side wall 302, 304 has an inner surface 330 and an outer surface 332 that transition into the inner and outer surfaces 310, 312, respectively, of the base wall 300. The side walls 302, 304 extend from the opposite side edges 314, 315, respectively, of the base wall 300. The side walls 302, 304 have cutouts 336 at a front 338 of the brake beam wear liner 270. Optionally, the cutout 336 may have a radiused surface. The side walls 302, 304 include a pair of outwardly extending rounded protuberances 340 that are configured to engage the guide bracket 152 to hold the brake beam wear liner 270 within the pocket 154.

The flanges 306, 308 extend outward from the side walls 302, 304, respectively, generally opposite the base wall 300. The flanges 306, 308 have inner surfaces 342 and outer surfaces 344 that transition into the inner and outer surfaces 330, 332, respectively, of the corresponding side wall 302, 304.

The base wall 300 has an initial longitudinal length 360 (shown in FIG. 10) measured between the first end 316 and the second end 317, which includes the longitudinal lengths of the central portion 320, as well as the first extension 324. After the first extension 324 is folded onto the central portion 320, the base wall 300 has a final longitudinal length 362 (shown in FIG. 11) measured between the rear end 322 and the front end 323. The final longitudinal length 362 is shorter than the initial longitudinal length 360 because the first extension 324 is folded over or under the central portion 320. Optionally, the initial longitudinal length 360 may be approximately two times the final longitudinal length 362.

Figure 12:
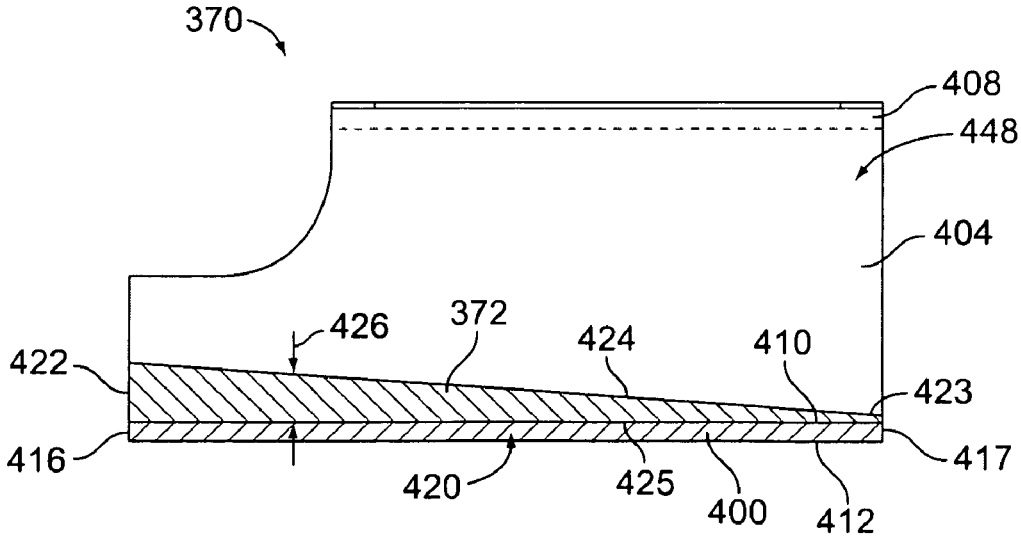
FIG. 12 is a cross sectional view of another alternative brake beam wear liner.

With reference to FIG. 12, a brake beam wear liner 370 is shown that includes an adapter portion 372 mounted thereto to provide an inclined surface on the base of the brake beam wear liner 370 and/or to add thickness to the brake beam wear liner 370 in selected locations of the brake beam wear liner 370. The brake beam wear liner 370 is similar to the brake beam wear liners 170, 270 in some respects, and may be used in place of the brake beam wear liners 170, 270. When manufactured, the brake beam wear liner 370 may have substantially similar size, shape and dimensions as the brake beam wear liner 170, such that the brake beam wear liners 170, 370 may be interchangeable. The brake beam wear liner 370 is configured to be received in corresponding pockets 154 (shown in FIG. 4) of the guide brackets 152 (shown in FIG. 4).

The brake beam wear liner 370 includes a base wall 400, side walls 404 (only one is shown in FIG. 12) extending from the base wall 400 and flanges 408 (only one is shown in phantom in FIG. 12) extending from the side walls 404. The brake beam wear liner 370 defines an open ended trough 448 between the side walls 404. The base wall 400 is provided at a bottom of the trough 448 opposite the open end of the trough 448.

In an exemplary embodiment, the brake beam wear liner 370 is manufactured to substantially conform to AAR standard S-367; however the adaptor portion 372 adds thickness to the base wall portion 400, which makes the brake beam wear liner 370 non-conforming.

The base wall 400 has an inner surface 410 and an outer surface 412. The base wall 400 extends between a rear end 416 and a front end 417. The base wall 400 has a generally uniform thickness along the length of the base wall 400.

The adaptor portion 372 includes a central portion 420 extending between a rear end 422 and a front end 423 (both shown in FIG. 11). The adaptor portion 372 includes an inner surface 424 and an outer surface 425 between the rear end 422 and the front end 423. The adaptor portion 372 has a non-uniform adapter thickness 426 measured between the inner and outer surfaces 424, 425. The adapter thickness 426 is greater proximate to the rear end 422 and is narrower proximate to the front end 423. The adaptor portion 372 may be manufactured from a metal material, such as a cast metal piece. Alternatively, the adaptor portion 372 may be manufactured from another material, such as nylon or synthetic material. The adapter portion 372 may be manufactured from a material selected to provide certain characteristics, such as improved friction or wear characteristics as compared to the material of the base wall portion 400.

During assembly, the adaptor portion 372 is coupled to the base wall portion 400. The adaptor portion 372 may be coupled to the base wall portion 400 using fasteners, latches, tabs, interlocking features, an interference fit, or other suitable connecting means or processes. Optionally, the adaptor portion 372 may be coupled to the inner surface 410 such that the outer surface 425 of the adaptor portion 372 engages and rests on the inner surface 410 of the base wall 400. The inner surface 424 thus defines the bottom of the trough 448.

Figure 13:
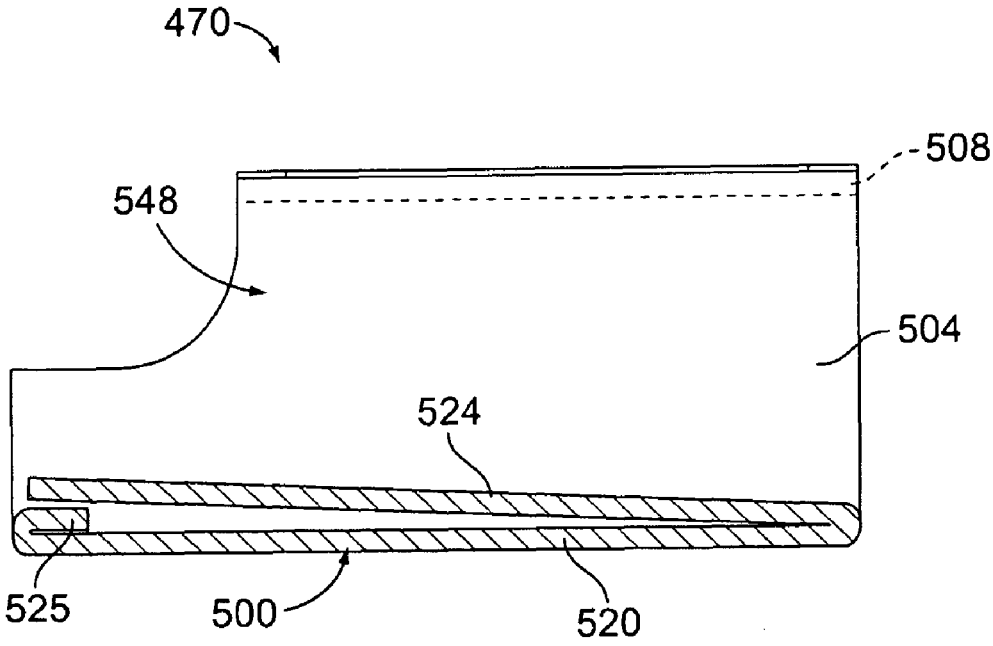
FIG. 13 is a cross sectional view of a further alternative brake beam wear liner.

With reference to FIG. 13, a brake beam wear liner 470 is shown. The brake beam wear liner 470 is similar to the brake beam wear liner 270 in some respects, and may be used in place of the brake beam wear liner 270. When manufactured, the brake beam wear liner 470 may have substantially similar size, shape and dimensions as the brake beam wear liner 270, such that the brake beam wear liners 270, 470 may be interchangeable. The brake beam wear liner 470 is configured to be received in corresponding pockets 154 (shown in FIG. 4) of the guide brackets 152 (shown in FIG. 4).

The brake beam wear liner 470 includes a base wall 500, side walls 504 (only one is shown in FIG. 13) extending from the base wall 500 and flanges 508 (only one is shown in phantom in FIG. 13) extending from the side walls 504. The brake beam wear liner 470 defines an open ended trough 548 between the side walls 504. The base wall 500 is provided at a bottom of the trough 548 opposite the open end of the trough 548.

The brake beam wear liner 470 differs from the brake beam wear liner 270, in that the brake beam wear liner 470 includes a first extension 524 and a second extension 525, as opposed to just a single extension as with the first extension 324 (shown in FIGS. 9-11). The second extension 525 is relatively shorter than the first extension 524. The second extension 525 extends from a rear end of the base wall 500 and the first extension 524 extends from a front end of the base wall 500. The second extension 525 is folded over prior to the first extension 524, and the distal end of the first extension 524 rests on the second extension 525. The second extension 525 holds the distal end of the first extension 524 elevated off a central portion 520 of the base wall 500 at an angle. Optionally, the first extension 524 may normally be elevated above the second extension 525, but when the brake beam 120 engages the first extension 524, such as when the brake beam 120 is moved to the advanced position, the first extension 524 may be deflected. The second extension 525 operates as a stop, which limits the amount of deflection of the first extension 524, thus maintaining the first extension 524 at an angle. The first extension 524 is tapered or angled downward from the second extension 525 to the central portion 520.

Figure 14:
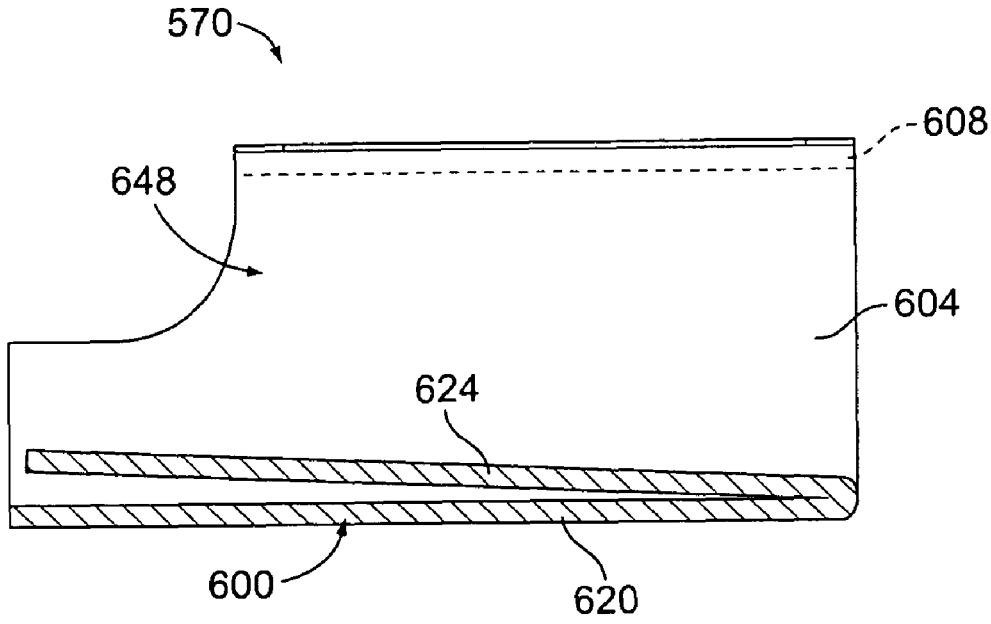
FIG. 14 is a cross sectional view of yet another alternative brake beam wear liner.

With reference to FIG. 14, a brake beam wear liner 570 is shown. The brake beam wear liner 570 is similar to the brake beam wear liner 270 in some respects, and may be used in place of the brake beam wear liner 270. When manufactured, the brake beam wear liner 570 may have substantially similar size, shape and dimensions as the brake beam wear liner 270, such that the brake beam wear liners 270, 570 may be interchangeable. The brake beam wear liner 570 is configured to be received in corresponding pockets 154 (shown in FIG. 4) of the guide brackets 152 (shown in FIG. 4).

The brake beam wear liner 570 includes a base wall 600, side walls 604 (only one is shown in FIG. 14) extending from the base wall 600 and flanges 608 (only one is shown in phantom in FIG. 14) extending from the side walls 604. The brake beam wear liner 570 defines an open ended trough 648 between the side walls 604. The base wall 600 is provided at a bottom of the trough 648 opposite the open end of the trough 648.

The brake beam wear liner 570 differs from the brake beam wear liner 270, in that the brake beam wear liner 570 includes a first extension 624 extending from a front end 622 of a central portion 620 of the base wall 600 rather than a rear end as is the case with the brake beam wear liner 270. The first extension 624 is cantilevered upward from the front end 622 and extends at an angle with respect to the central portion 620.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A brake beam wear liner for receiving a brake beam assembly, the brake beam wear liner comprising:

a base wall extending between a rear end and a front end, the base wall having opposite side edges, the base wall having a tapered thickness between the rear end and the front end, the base wall being thicker proximate to the rear end and being narrower proximate to the front end;

sidewalls extending from the opposite side edges, the sidewalls and the base wall defining an open ended trough configured to receive an end of the brake beam assembly; and flanges extending outward from the sidewalls generally opposite the base wall, wherein the base wall has a constant taper along a length of the base wall between the rear and front ends.

2. The brake beam wear liner of claim 1, wherein the base wall has an inner surface and an outer surface, the inner surface facing the open ended trough, the outer surface facing a corresponding guide bracket holding the break beam wear liner, the inner surface being angled with respect to the outer surface such that the inner surface and outer surface are non-parallel.

3. The brake beam wear liner of claim 1, wherein a depth of the open ended trough decreases along a length thereof between the front end and the rear end, the depth being defined between the flanges and the base wall.

4. A brake beam wear liner for receiving a brake beam assembly, the brake beam wear liner comprising:

a base wall extending between a rear end and a front end, the base wall having opposite side edges, the base wall having a tapered thickness between the rear end and the front end, the base wall being thicker proximate to the rear end and being narrower proximate to the front end;

sidewalls extending from the opposite side edges, the sidewalls and the base wall defining an open ended trough configured to receive an end of the brake beam assembly; and flanges extending outward from the sidewalls generally opposite the base wall, wherein the base wall is die cast using a mold that defines the tapered thickness of the base wall.

5. A brake beam wear liner for receiving a brake beam assembly, the brake beam wear liner comprising:

a base wall extending between a rear end and a front end, the base wall having opposite side edges, the base wall having a tapered thickness between the rear end and the front end, the base wall being thicker proximate to the rear end and being narrower proximate to the front end;

sidewalls extending from the opposite side edges, the sidewalls and the base wall defining an open ended trough configured to receive an end of the brake beam assembly; and flanges extending outward from the sidewalls generally opposite the base wall, wherein the base wall includes a central portion and a longitudinal extension extending from an end of the central portion, the longitudinal extension being folded over the central portion into the open ended trough, the longitudinal extension being angled with respect to the central portion such that the base wall has the tapered thickness.

6. A brake beam wear liner for receiving a brake beam assembly, the brake beam wear liner comprising:

a base wall extending between a rear end and a front end, the base wall having opposite side edges, the base wall having a tapered thickness between the rear end and the front end, the base wall being thicker proximate to the rear end and being narrower proximate to the front end;

sidewalls extending from the opposite side edges, the sidewalls and the base wall defining an open ended trough configured to receive an end of the brake beam assembly; and flanges extending outward from the sidewalls generally opposite the base wall, wherein the base wall includes a central portion and a longitudinal extension extending from an end of the central portion, the longitudinal extension being folded over the central portion into the open ended trough, the longitudinal extension being deflectable within the open ended trough such that the longitudinal extension operates as a spring member configured to engage, and be spring biased against, the brake beam assembly.

7. A brake beam wear liner for receiving a brake beam assembly, the brake beam wear liner comprising:

a base wall extending between a rear end and a front end, the base wall having opposite side edges, the base wall having a tapered thickness between the rear end and the front end, the base wall being thicker proximate to the rear end and being narrower proximate to the front end;

sidewalls extending from the opposite side edges, the sidewalls and the base wall defining an open ended trough configured to receive an end of the brake beam assembly; and flanges extending outward from the sidewalls generally opposite the base wall, wherein base wall has a first thickness at the rear end and a second thickness at the front end, the first thickness being at least twice the second thickness.

8. A brake beam wear liner for receiving a brake beam assembly, the brake beam wear liner comprising:

a base wall extending between a rear end and a front end, the base wall having opposite side edges, the base wall having a tapered thickness between the rear end and the front end, the base wall being thicker proximate to the rear end and being narrower proximate to the front end;

sidewalls extending from the opposite side edges, the sidewalls and the base wall defining an open ended trough configured to receive an end of the brake beam assembly; and flanges extending outward from the sidewalls generally opposite the base wall, wherein the base wall includes a central portion and an adapter separately provided from, and coupled to, the central portion, the central portion having a uniform thickness, the adapter having a non-uniform thickness, wherein the base wall has the tapered thickness when the adapter is coupled to the central portion.

* * * * *